United States Patent [19]

Fujimoto

[11] 4,097,041

[45] Jun. 27, 1978

[54] SHEET FEEDING APPARATUS

[75] Inventor: Sakae Fujimoto, Chofu, Japan

[73] Assignee: Ricoh Company, Ltd., Tokyo, Japan

[21] Appl. No.: 738,222

[22] Filed: Nov. 2, 1976

[30] Foreign Application Priority Data

Nov. 6, 1975 Japan ..... 50-133206

[51] Int. Cl.[2] ..... B65H 3/06; B65H 3/56

[52] U.S. Cl. ..... 271/114; 271/110; 271/118; 271/121; 271/170

[58] Field of Search ..... 271/118, 117, 170, 110, 271/111, 114, 116, 121, 124

[56] References Cited

U.S. PATENT DOCUMENTS

| | | | |
|---|---|---|---|
| 1,098,279 | 5/1914 | Martin | 271/111 |
| 3,021,136 | 2/1962 | Fox | 271/114 |
| 3,319,956 | 5/1967 | Bishop | 271/170 |
| 3,476,381 | 11/1969 | Carlson | 271/117 |
| 3,532,423 | 10/1970 | Bruning et al. | 271/117 X |
| 3,539,178 | 11/1970 | Yanagawa | 271/117 |

*Primary Examiner*—Bruce H. Stoner, Jr.
*Attorney, Agent, or Firm*—Cooper, Dunham, Clark, Griffin & Moran

[57] ABSTRACT

An apparatus is disclosed which feeds sheets from a stack one by one separated from each other, the sheets being of the type which are cut to size and placed in a stack on a sheet receptacle. The apparatus comprises: a feed roller for feeding each sheet from the top of the stack, which roller is raised in a direction away from the sheets as each feeding of a sheet from the stack is terminated; drive means for operating the feed roller and control means for the drive means; means for causing the feed roller to move up and down for each feeding operation; and a pair of corner separators disposed at the opposite corners of the front end of the sheet receptacle for vertical movement in following relationship with the vertical movement of the feed roller. The corner separators operate to bear against the corners of the front end of the sheets only during the sheet feeding operation.

9 Claims, 12 Drawing Figures

SHEET FEEDING APPARATUS

BACKGROUND OF THE INVENTION

The invention relates to a sheet feeding apparatus which may be used in a facsimile transceiver, a copying machine or duplicating machine, and more particularly, to such apparatus which feeds sheets, disposed in a stack on a sheet receptacle, separated from each other by means of corner separators for delivery into the facsimile transceiver or the like.

In apparatus of the kind described which is adapted to feed sheets, cut to size, one by one separated from each other, it is known to use corner separators which are urged to bear against the opposite corners of the front end of the sheets placed on the sheet receptacle. It is necessary to raise the corner separators when a stack of sheets is to be placed on the receptacle. To feed a sheet from a stack thereof, two schemes are known. In one scheme, the sheet receptacle is stationary while a feed roller is made movable toward or away from the uppermost sheet. In the other scheme, the feed roller is disposed at a fixed position while the sheet receptacle is moved to bring the sheets thereon into contact with the feed roller. In either scheme, the contact between the feed roller and the sheet is maintained once it is established. Thus, when a stack of sheets is to be placed on the receptacle, it is necessary to provide an open space between the feed roller and the sheet receptacle.

Copying machines are known which use a plurality of sheet cassettes containing sheets of different sizes. Also, a facsimile transceiver employs a different sheet cassette for originals to be transmitted and record sheets used for reception. In these instances, it is inconvenient to raise the feed roller when the individual sheet cassettes are either loaded or removed.

SUMMARY OF THE INVENTION

The sheet feeding apparatus according to the invention comprises a feed roller which is movable toward or away from a sheet receptacle, and a pair of corner separators which operate to separate sheets from each other when a sheet is to be fed, the corner separators moving in following relationship with the feed roller. The feed roller is rotatably mounted on a support arm which has its free end arranged to be movable toward or away from an uppermost sheet on the sheet receptacle. Drive means is provided for rotating the feed roller, and means is associated with the drive means for controlling the operation thereof. Additionally, means is provided for rocking the support arm in a direction to move the feed roller away from the stack of sheets when a feeding operation of one sheet is completed. The apparatus also comprises means for holding the support arm in its raised position, means for releasing the support arm from the raised position, and means for mounting the pair of corner separators disposed adjacent to the opposite corners of the front end of the sheet receptacle for vertical movement in following relationship with the movement of the feed roller.

Therefore, it is an object of the invention to provide a sheet feeding apparatus in which the sheets are retained by the corner separators only during a sheet feeding operation and wherein the feed roller and corner separators are moved away from the sheet receptacle which either carries a stack of sheets or is empty each time a sheet feeding operation is completed, thereby enabling a rapid and facilitated sheet loading.

It is another object of the invention to provide a sheet feeding apparatus in which as the feed roller moves upward upon completion of a feeding operation, the corner separators which follow the movement of the feed roller become freely movable away from the front end of the stack of sheets, thereby reducing the resistance between the corner separators and the sheets.

It is a further object of the invention to provide a sheet feeding apparatus in which the pressure with which the corner separators bear against the sheets is maintained constant despite a variation in the number of sheets contained in the stack on the sheet receptacle.

DETAILED DESCRIPTION OF PREFERRED EMBODIMENTS

Figure 1:
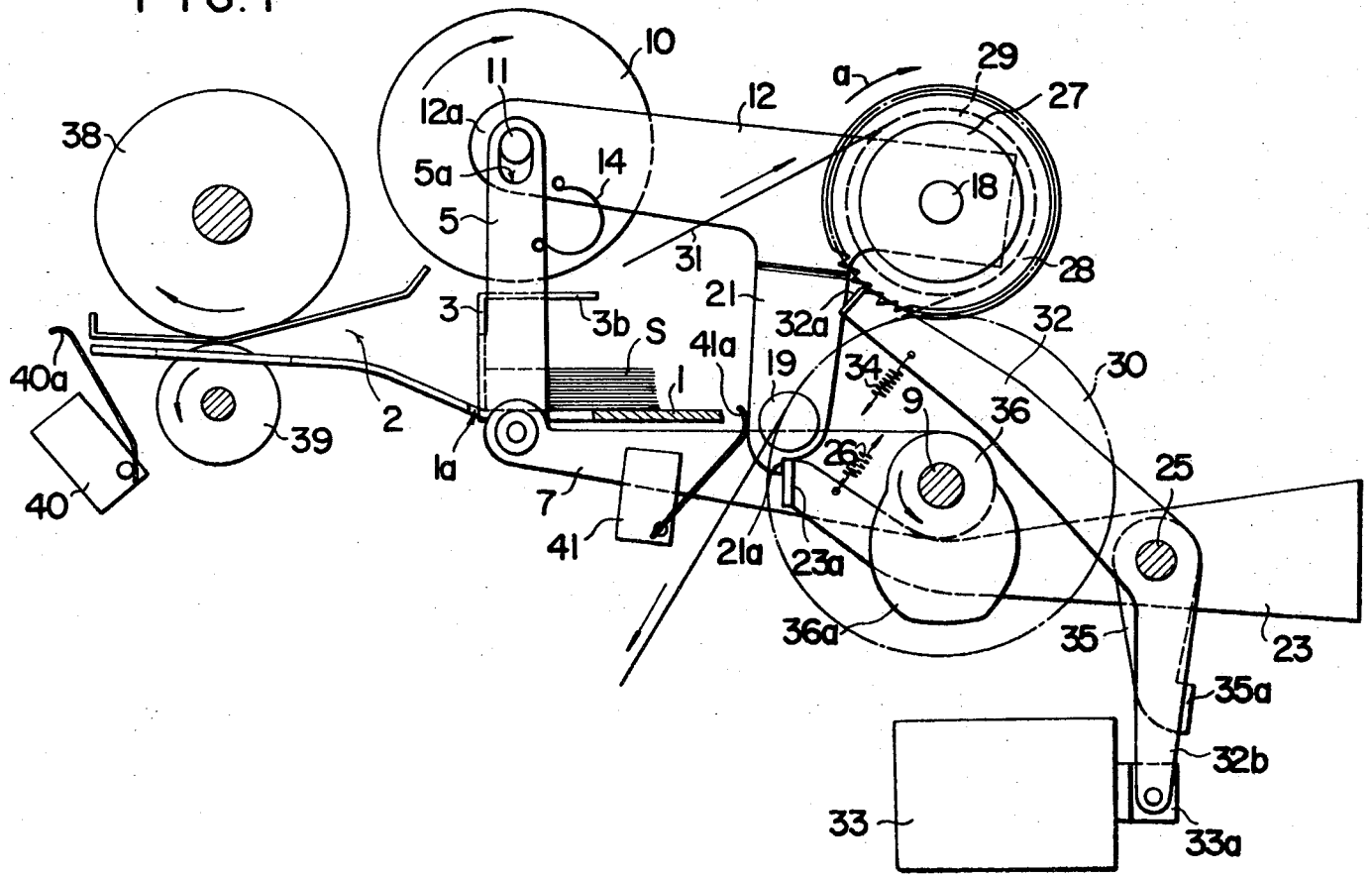
FIG. 1 is a side elevation of the sheet feeding apparatus according to the invention when it is not feeding a sheet.

Referring to FIG. 1, there is shown sheet receptacle 1 (see FIGS. 4 and 4 also) on which a stack of sheets S is disposed. As viewed in this Figure, the receptacle 1 is provided with an extension extending to the left to form a sheet passageway 2. Along its opposite corners, the front end of the receptacle 1 is formed with a pair of notches 1*a*, 1*b* (see FIG. 4), into which a pair of corner separators 3, 4 are loosely fitted. The corner separators 3, 4 comprise abutment portions 3*a*, 4*a* against which the leading edges of the sheets may be disposed in abutment for the purpose of alignment, and a corner claws 3*b*, 4*b* which bear against the corners of the leading end of the sheets from above. The corner separators 3, 4 are integrally supported by respective support links 5, 6, which are pivotally mounted at their lower ends on the free ends of arms 7, 8, respectively. The other ends of the arms 7, 8 are loosely fitted on a shaft 9. The upper ends of the support links 5, 6 are formed with elongate slots, 5*a* (a slot for the support link 6 being not shown), which are loosely engaged by respective ends 11*a*, 11*b* of a support shaft 11 on which a feed roller 10 is fixedly mounted. The feed roller 10 is adapted to be driven for rotation in a direction indicated by an arrow, by drive means to be described later.

Figure 4:
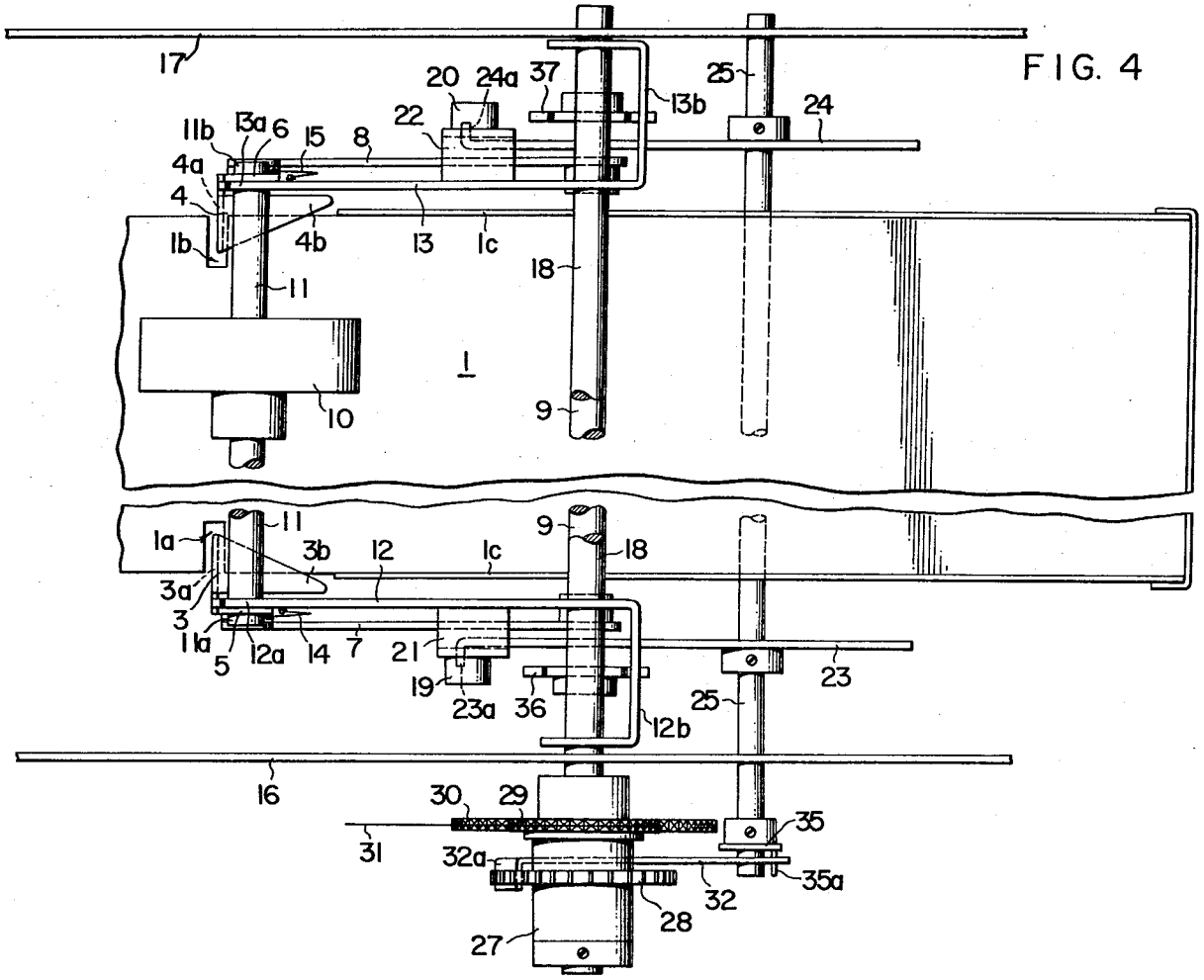
FIG. 4 is a plan view of the apparatus.

Support shaft 11 is rotatably mounted by having its ends 11*a*, 11*b* loosely fitted in openings formed in the free ends 12*a*, 13*a* of feed roller support arms 12, 13 (see FIG. 4). These support arms and the support links 5, 6 are connected together by respective springs 14, 15. In this manner, the links 5, 6, arms 7, 8 and support arms 12, 13 constitute together linkages. At their other ends 12*b* 13*b*, the support arms 12, 13 are freely fitted on a drive shaft 18 for the feed roller which is rotatably mounted on a pair of sideplates 16, 17 which are located on the opposite sides of the sheet receptacle 1, as shown in FIG. 4. In this manner, these support arms 12, 13 tend to rotate about the drive shaft 18 toward the sheet receptacle 1 under the influence of their own weight.

The lower edges of the support arms 12, 13 have downwardly depending arms 21, 22 formed therewith which carry rollers 19, 20 (see FIG. 4). As shown in FIG. 1, the lower end of the dependent arm 21, is formed with a step 21*a* (a step is also formed in the arm 22 but not shown). The steps in the depending arms 21, 22 are engaged by detent pieces 23*a*, 24*a* which are folded from the free ends of holding arms 23, 24. These holding arms 23, 24 are substantially fixedly mounted on a shaft 25 which is rotatably mounted in the sideplates 16, 17, and are urged by a spring 26 to rotate clockwise about the shaft 25 as viewed in FIG. 1. The engagement between the holding arms 23, 24 and the depending arms 21, 22 maintains the feed roller support arms 12, 13 in their raised position in which the feed roller 10 is removed from engaging the sheets S.

Figure 5:
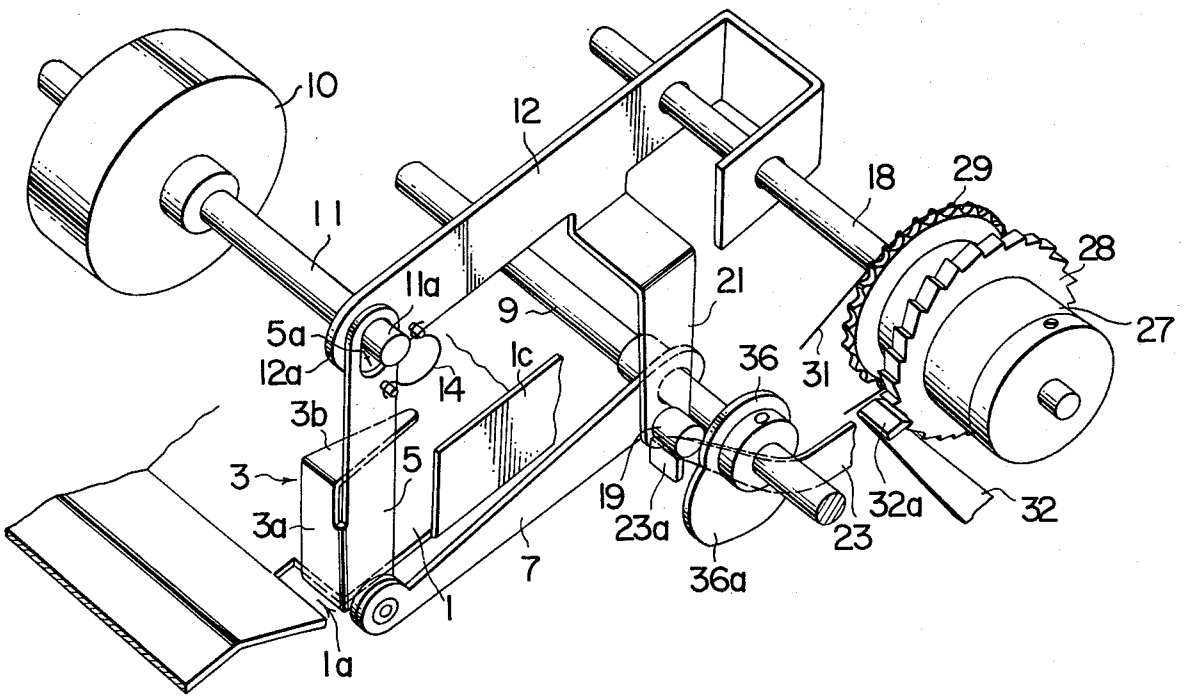
FIG. 5 is a fragmentary perspective view of the apparatus.

As shown in FIG. 4, mounted on one end of the drive shaft 18 are a ratchet wheel 28 and a sprocket wheel 29 (see also FIG. 5). The ratchet and sprocket wheels 28, 29 are coupled together by a clutch 27 of a helical spring type. When the ratchet wheel 28 is freely rotatable, the spring tightens itself to achieve a coupling between the both wheels 28, 29 to transmit rotation of the sprocket 29 to the shaft 18, while when the ratchet 28 is held against rotation, the sprocket 29 is free to rotate but the rotation thereof is not transmitted to the shaft 18. A chain 31 connected with a drive mechanism, not shown, extends around the sprocket wheel 29 and another sprocket wheel 30 which is fixedly mounted on the shaft 9 which is disposed in vertical alignment with shaft 18 (see FIG. 4). Chain 31 is adapted to be driven to rotate sprocket wheel 29 in the direction indicated by an arrow *a* shown in FIG. 1. The rotation of the sprocket wheel 29 is transmitted through the one way clutch 27 to the drive shaft 18, but the transmission of the rotation can be interrupted by disabling rotation of the ratchet wheel 28.

The ratchet wheel 28 is engaged by a pawl 32*a* formed on one end of a detent lever 32 which is rotatably mounted on the shaft 25, whereby wheel 28 is prevented from rotation. The detent lever 32 has its other end 32*b* connected with an armature 33*a* of an electromagnet 33. A spring 34 having a stronger resilience than the spring 26 urges the detent lever 32 to rotate counterclockwise about the shaft 25. When the various parts assume their positions shown in FIG. 1, the electromagnet 33 is not energized, and the detent lever 32 tends to rotate counterclockwise under the resilience of the spring 34, but the resulting movement is blocked by a lever 35 to be described below.

Fixedly mounted on the shaft 25 is a release lever 35 having a folded piece 35*a*, which in turn engages the other end 32*b* of the detent lever 32 in a manner to prevent its rotation. The release lever 35 is substantially integral with the holding arms 23, 24 as all are fixedly mounted on the shaft 25. The detent lever 32 and the holding arm 23 are urged for rotation by the springs 34 and 26, respectively, and since it has been mentioned that the spring 34 has a stronger resilience than the spring 26, it may appear contradictory that the movement of the release lever 35 is blocked thereby. However, the step 21*a* of the depending arm 21 is engaged by the detent piece 23*a* to maintain the engagement therebetween, whereby the pawl 32*a* on the detent lever 32 is maintained in engagement with the ratchet wheel 28.

The shaft 9 is rotatably mounted in the sideplates 16, 17, and a pair of release cams 36, 37 are fixedly mounted on the shaft 9 at positions in which they are aligned with the rollers 19, 20 on the depending arms 21, 22 (see FIG. 4). Considering one of these release cams, namely, cam 36, it has a portion 36*a* of an increased diameter which is adapted to bear against the roller 19 during its rotation when the engagement between the depending arm 21 and the holding arm 23 is maintained (see FIG. 1).

Figure 6:
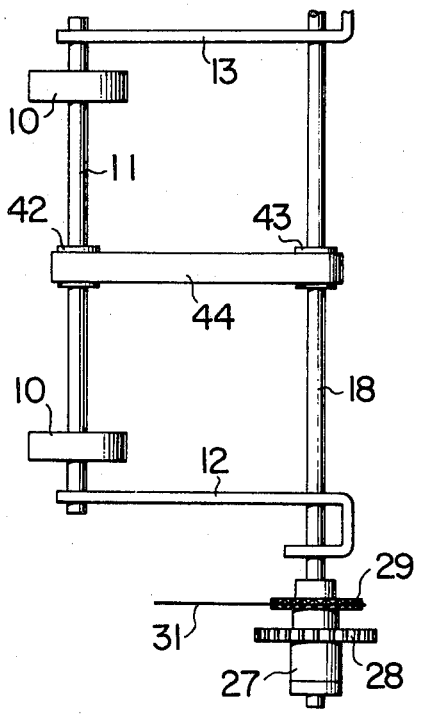
FIG. 6 is a plan view of one form of drive means associated with the feed roller.

A pair of sheet feeding rollers 38, 39 are disposed on the opposite sides of the sheet passageway 2 to bear against each other while rotating in respective directions indicated by arrows. While not shown, a suitable slot is formed in the extension of the receptacle. A sheet detecting switch 40 having its actuator 40*a* disposed along the sheet passageway 2 is also provided, and is adapted to be operated by a sheet being conveyed to energize the electromagnet 33. A control switch 41 having its actuator 41*a* located on the path of movement of the depending arm 21 is located at a position below and to the left of this arm. The switch 41 is operated as the depending arm 21 rocks, producing a signal which is applied to a drive mechanism, not shown. As shown in FIG. 6, fixedly mounted on the support shaft 11 and the drive shaft 18 of the feed roller are a pair of pulleys 42, 43, respectively, around which a belt 44 extends. In this manner, the shafts 11 and 18 rotate integrally. In FIGS. 4 and 5, a reference character 1*c* represents a sideplate of the sheet receptacle 1.

FIG. 1 shows a start position of the sheet feeding apparatus according to the invention. Referring to FIG. 1, when a stack of sheets S is placed on the receptacle 1 and a feed button, not shown, depressed, the drive mechanism, not shown, is set in motion to drive the chain 31 in the direction of the arrows, thereby causing the sprocket wheel 29 to rotate in the direction of the arrow *a* and causing the sprocket wheel 30 to rotate in the counterclockwise direction. The rotation of the sprocket wheel 29 is not transmitted to the drive shaft 18 since the ratchet wheel 28 is locked by the detent pawl 32*a* on the detent lever 32. On the other hand, as the sprocket wheel 30 rotates counterclockwise, the rotation is transmitted through the shaft 9 to cause the release cam 36 to rotate in the same direction, whereby the portion 36*a* of an increased diameter comes to bear against the roller 19. Thereupon, the depending arm 21 is rocked slightly clockwise about the drive shaft 18. This rocking motion of the depending arm 21 tends to reduce the engagement between the step 21*a* and the folded piece 23*a*. As a consequence, the release lever 35 is driven in the counterclockwise direction by the detent lever 32 under the action of spring 34, and the arm 23 which is substantially integral with the release lever 35 is rotated in the same direction. Depending arm 21 moves downward along the cam profile of the cam 36 as a result of the retracting movement of the holding arm 23 (see FIG. 2) so that the support arm 12 rotates counterclockwise about the drive shaft 18.

Figure 2:
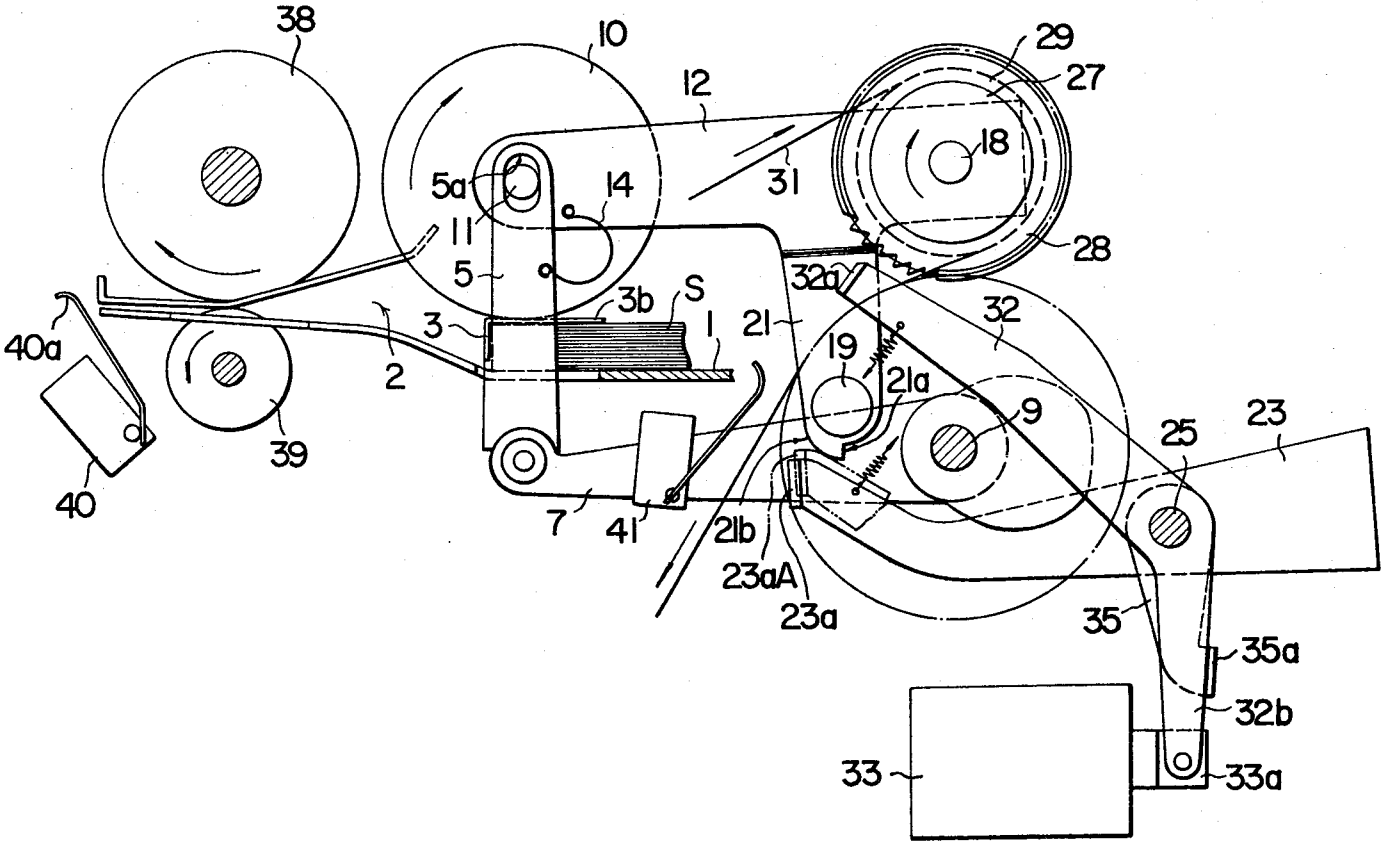
FIG. 2 is a side elevation of the apparatus shown in FIG. 1 during a sheet feeding operation.

As the support arm 12 rotates in the manner mentioned above, the support link 5 and the arm 7 which form a linkage assembly together therewith move in a manner such that the claw 3*b* supported by the support link 5 bears against the leading end of the uppermost sheet S (see FIG. 2). The rocking motion of the claw 3*b* will be further described later. As a result of the abutment of the claw 3*b* against the uppermost sheet S, the support link 5 is prevented from continuing its downward movement while the support arm 12 is allowed to move down until the feed roller 10 bears against the uppermost sheet S before it comes to a stop. The resilience of the spring 14 acts to force the corner separators downward if they are jammed by friction with the leading edge of the sheets.

On the other hand, as a result of rotation of the holding arm 23, the detent lever 32 which is now allowed to rotate in the direction in which it is urged by the spring 34 moves counterclockwise about the shaft 25, thus releasing the ratchet wheel 28 from the pawl 32*a*. The rotation of the sprocket wheel 29 is then transmitted through the one way clutch 27 to the drive shaft 18. The resulting rotation of the drive shaft 18 is transmitted through the belt 44 to the support shaft 11, as shown in FIG. 6, thereby causing a rotation of the feed roller 10. Thus, the feed roller 10 is already rotating when the support arm 12 moves down, and immediately feeds the uppermost sheet S upon contact therewith. Immediately before the engagement of the feed roller 10 with the uppermost sheet S, the claws 3*b*, 4*b* bear against the opposite corners of the leading end of the sheet, so that the sheet S being fed is separated from the remainder of the stack. Such construction of the corner separators which permits the uppermost sheet to be fed while retaining the remaining sheets is well known in the art.

It is to be understood that the above description concerning the downward movement of the feed roller 10 is given in terms of only one of the support arms 12, 13, depending arms 21, 22, support links 5, 6, arms 7, 8, release cams 36, 37 and claws, which however actually form respective pairs as shown in FIG. 4.

Figure 3:
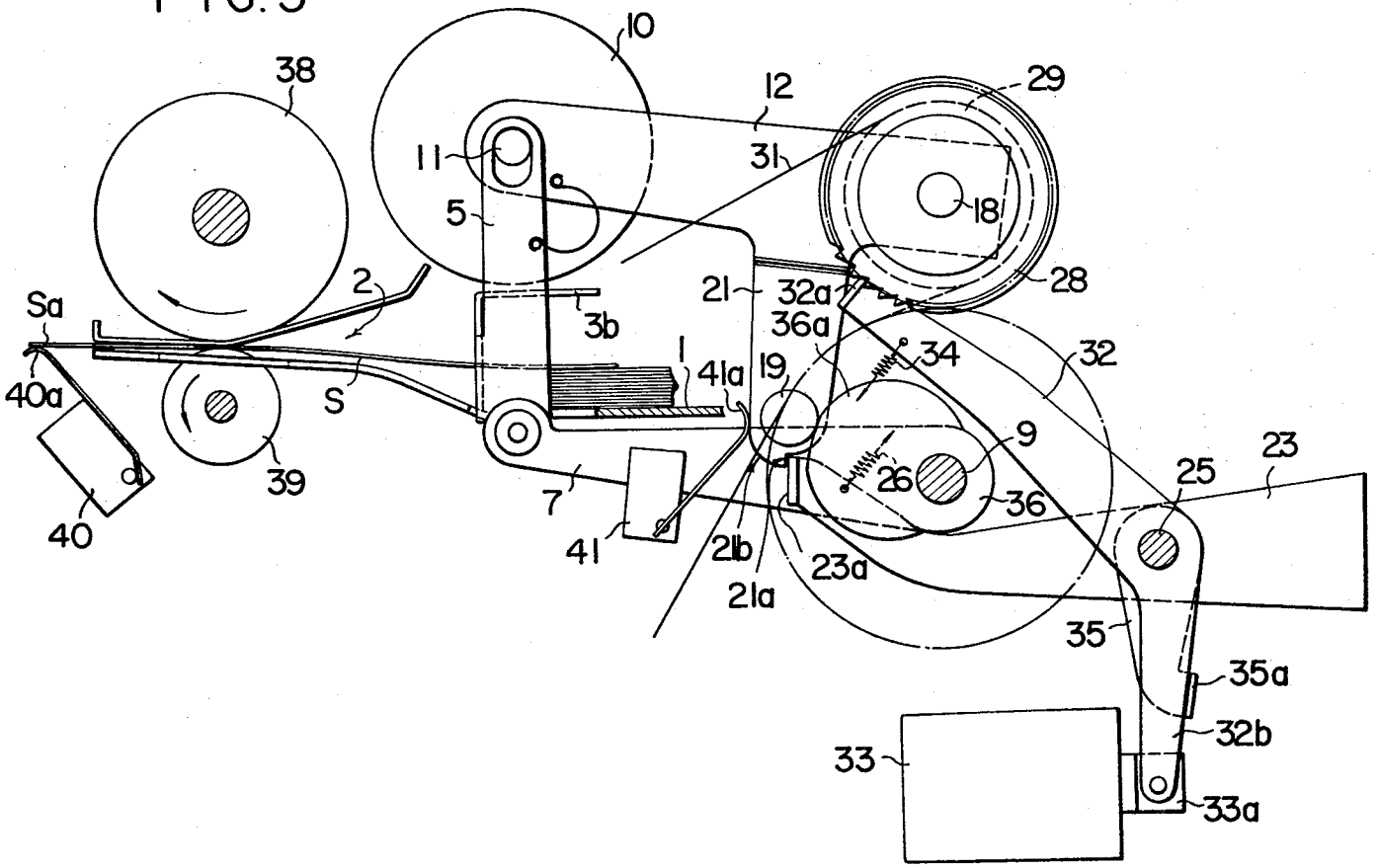
FIG. 3 is a side elevation of the apparatus immediately before the feed roller is held in its raised position as the apparatus changes from its feeding to its non-feeding position.

As the sheet S is fed by the feed roller 10, it is conveyed on the sheet passageway 2 into the nip between the sheet feeding rollers 38, 39, and thereafter operates the actuator 40*a* of the switch 40 with its leading end Sa, as shown in FIG. 3. When the switch 40 is actuated, the electromagnet 33 is energized to attract the armature 33*a*. Thereupon, the detent lever 32 is rotated clockwise about the shaft 25 against the resilience of the spring 34, bringing the pawl 32*a* into meshing engagement with the ratchet wheel 28 to prevent its further rotation. When the rotation of the ratchet wheel 28 is interrupted, the one way clutch 27 acts to interrupt the transmission of rotation to the drive shaft 18 through the chain 31, whereby the feed roller 10 ceases to rotate.

When the detent lever 32 is rotated in the manner mentioned above, the release lever 35 which has been driven by one end 32*b* thereof is now permitted to rotate clockwise, under the resilience of the spring 26, together with the holding arm 23 which is substantially integral therewith. The folded piece 23*a* on the rotating holding arm 23 bears against an arcuate portion 21*b* located on the rear side of the step 21*a*, as shown in phantom line 23*a*A in FIG. 2.

At substantially the same time as the feed roller 10 ceases to rotate, the release cam 36 bears against and drives the roller 19. This results in a clockwise rotation of the depending arm 21 or the support arm 12 about the drive shaft 18, so that the feed roller 10 and the corner separators 3 are separated from the sheets and raised. At the maximum stroke of the depending arm 21 which is rocked by the release cam 36, the lower edge of the arm 21 operates on the actuator 41*a* of the control switch 41, which then becomes effective to stop the drive mechanism, not shown, which is used to drive the chain 31. However, it is to be understood that after the drive mechanism has been stopped, the chain 31 continues to rotate by inertia, and the release cam 36 comes to a stop at a position which approximately corresponds to its position shown in FIG. 1.

As shown in FIG. 3, when the roller 19 is expelled by the release cam 36 to its maximum stroke and the support arm 12 is raised to its highest position, the folded piece 23*a* is disengaged from abutment against the arcuate portion 21*b* (shown in phantom line in FIG. 2) and becomes engageable with the step 21*a*. The rotation of the holding arm 23 under the resilience of the spring 26 continues until there occurs the engagement between the folded piece 35*a* of the release lever 35 which is substantially integral with the holding arm 23 and the end 32*b* of the detent lever.

Substantially, as the release cam 36 changes its position of engagement with the roller 19 while continuing to rotate by inertia, the roller 19 moves down along the cam profile. The downward movement of the roller 19 represents its rocking motion about the drive shaft 18 which takes place under gravity, and is terminated when the step 21*a* is engaged with the folded piece 23*a*. The support arm 12 is now maintained in its raised position as shown in FIG. 1.

During the rocking motion of the depending arm 21, the control switch 41 is turned off as its actuator 41*a* rocks, but does not produce a starting signal for the drive mechanism when it is turned back on. The switch 40 may be included in a suitable circuit such as one which is connected in parallel with the feed button. When the traveling sheet S (see FIG. 3) which has actuated the sheet detecting switch 40 has its trailing end disengaged from the actuator 40*a*, the switch 40 is operated to deenergize the electromagnet 33. Thereupon, the lever 32 is freed from the action of the electromagnet 33 and tends to rotate counterclockwise under the resilience of the spring 34, but the resulting rotation is blocked by the engagement between the depending arm 21 and the holding arm 23. It is to be noted that the sheet feeding rollers 38, 39 are driven for rotation by means which is separate from the above-mentioned drive mechanism associated with the feed roller 10. When the electromagnet 33 is deenergized or a feeding operation of a single sheet is completed, the entire apparatus returns to the start position shown in FIG. 1 in preparation for a next sheet feed instruction.

Figure 7:
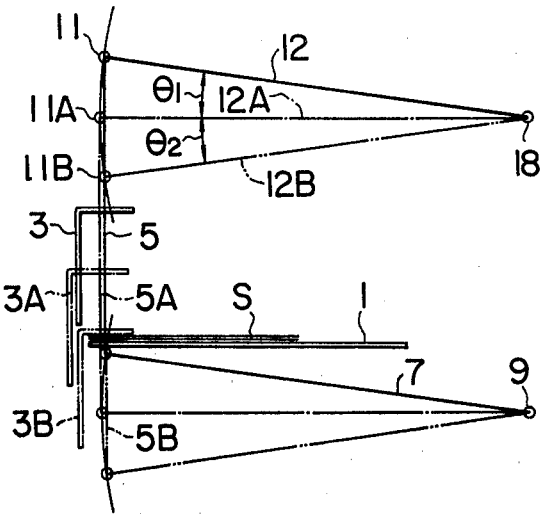
FIG. 7 is a diagrammatic view illustrating the movement of the corner separators in the apparatus of the invention.

Referring to FIG. 7, the movement of the corner separators 3, 4 will be considered in more detail. When a sheet feed instruction is issued, the support arms 12, 13 rock through positions 12A, 12B about the drive shaft 18, in the sequence named. The support link 5 which forms one element of the linkage including the support arm 12 and the arm 7 moves downward as indicated by positions 5A, 5B, so that the claw 3*b* of the corner separator 3 which is integral with the support link bears against the uppermost sheet S along with claw 4b which moves in a similar manner.

When the sheets are loaded on the receptacle, the leading edges of the sheets are brought into alignment with each other by bringing them into engagement with the abutment portions 3a 4a, of the corner separators 3, 4 when the latter assume the raised position. As the support arm 12 rocks, the corner separator 3 becomes free to move away from the leading edges of the sheets, as indicated at 3A, and finally bears against the sheets from above as shown at 3B. Taking the positions 12A, 5A of the support arm 12 and the support link 5 as a reference in which these members from right angles therebetween, FIG. 7 shows an angle of $\theta_1$ between the support arm 12 in its raised position and the support and the support arm 12 at position 12A, and also an angle of $\theta_2$ formed between the support arm at position 12A and the support arm 12 in its lowermost position during a sheet feeding operation or position 12B. For $\theta_1 = \theta_2$, the abutment portions 3a, 4a of the corner separators will bear against the leading edges of the sheets in either position while for $\theta_1 > \theta_2$, the abutment portions bear against the leading edges of the sheets in the raised position, but not in the position 3B. For $\theta_1 < \theta_2$, the corner separators in their sheet retaining position will have to be located rearwardly or to the right, as viewed in this Figure, of the position which they assume when the sheets are loaded. This requires that a stack of sheets be moved rearwardly by pushing them with the corner separators, which may result in the inconvenience that the downward movement of the corner separators as well as the feed roller may be impeded. Therefore, it is desirable that $\theta_1 \geqq \theta_2$.

The movement of the corner separators will be evident from a consideration of the linkage movements described above. In either upward or downard movement, they initially move away from the leading edges of the sheets, and finally assume a position in which they act to align the sheets. As mentioned above, with the linkages in the raised position, the leading edges of the sheets upon loading are brought into bearing engagement with the corner separators to achieve an alignment of the sheets while during a sheet feeding operation, the leading edges of the sheets are brought into similar bearing engagement by the feed roller. It will be appreciated that a movement of the corner separators will encounter an increased resistance when they maintain such bearing engagement with the leading edges of the sheets. However, such resistance can be avoided when the corner separators are free to move away from the sheets.

As discussed above, the sheet feeding apparatus according to the invention operates such that the feed roller and the corner separators are moved away from the sheets or sheet receptacle and retained in their raised position upon completion of a feeding operation of a single sheet. Therefore, when a sheet feeding operation does not take place, sufficient space is available between the feed roller and the corner separators on one hand and the sheets or the sheet receptacle on the other hand to enable the loading of sheets in a rapid and facilitated manner. Since the corner separators are connected with the feed roller support arms for vertical movement in following relationship therewith, they are free to move away from the leading edges of the sheets when they begin to move, thus reducing a resistance presented by the sheets during their movement.

While in the embodiment shown, the sheet feeding rollers 38, 39 are normally in abutting relationship with each other, an alternative arrangement is also possible. For example, these rollers 38, 39 may be normally maintained removed from each other, and then brought into abutting relationship, subsequent to the interruption of the conveying drive to the sheet (interruption of rotation of the feed roller 10), in response to the actuation of the sheet detecting switch 40 by the leading end of the sheet to energize the solenoid 33. In this instance, means may be provided for deenergizing the solenoid 33 in response to the actuation of the control switch 41, subsequent to the establishment of the engagement between the step 21a and the folded piece 23a. Furthermore, in place of relying on the connection with the support arm, the movement of the corner separators away from the sheets may be achieved by a bias applied to the corner separators themselves.

Figure 9:
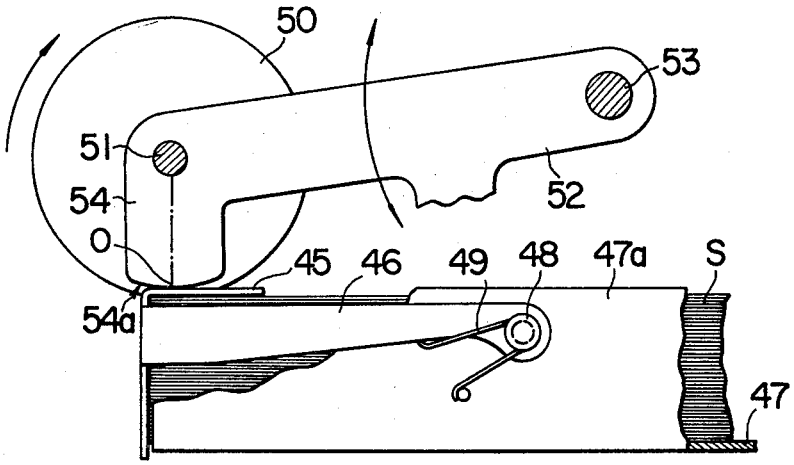
FIG. 9 is a fragmentary side elevation of the embodiment shown in FIG. 8.
Figure 8:
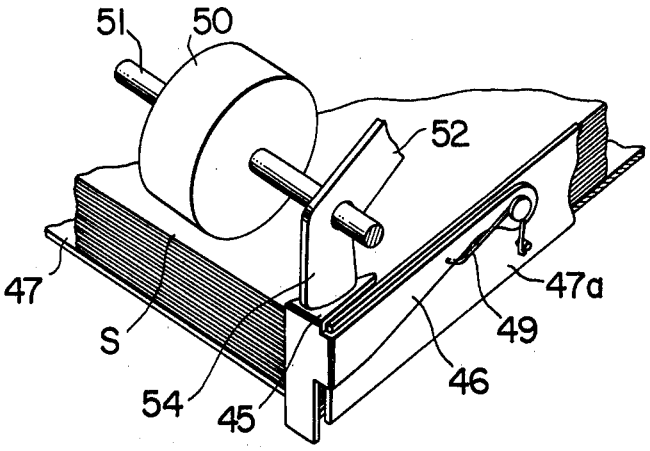
FIG. 8 is a fragmentary perspective view of another embodiment of the invention.

Referring to FIGS. 8 and 9, there is shown another embodiment of the invention which incorporates biased corner separators 45 (only one being shown). The separator 45 is formed at the free end of a support arm 46 which is rockably mounted on a stub shaft 48 which is fixedly mounted on a sideplate 47a of a sheet receptacle 47. The support arm 46 is biased by a spring 49 to cause the corner separator 45 to move away from the sheet receptacle 47. A stack of sheets S is placed on the receptacle 47, with the leading edges of the sheets being aligned with each other. A feed roller 50 is disposed above the front end of the receptacle 47, and is fixedly mounted on a shaft 51 which is adapted to be driven for rotation by drive means as described in the previous embodiment. The drive shaft 51 is rotatably carried by the free ends of feed roller support arms 52, which have their other ends loosely fitted on a feed roller drive shaft 53. The support arms 52 are mounted so as to oscillate about the drive shaft 53 by means of a rocking mechanism as mentioned above in connection with the previous embodiment.

The free ends of the support arms 52 are formed with corner separator urging members 54 having an arcuate portion 54a which is concentric with the support shaft 51 and which has a radius of curvature which is slightly less than the radius of feed roller 50. The arcuate portions 54a directly bear against the corner separators 45. The difference in the radius of the arcuate portions 54a and the feed roller 50 is chosen to be slightly greater than the thickness of the corner separator 45. When a sheet feeding operation does not take place, the feed roller 50 is maintained in its raised position away from the stack of sheets S, by the support arms 52 which are adapted to rock clockwise about the drive shaft 53. Since the corner separators 45 are biased by the spring 49 to move away from the sheets S, they move upward as the roller 50 is raised.

Figure 10:
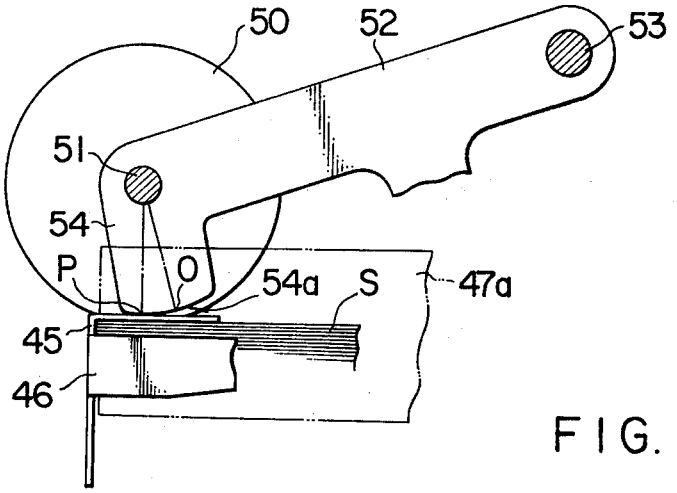
FIG. 10 is a similar view to FIG. 9 illustrating the operation thereof.

Assuming that a stack of sheets S is placed on the sheet receptacle 47, a sheet feed instruction subsequently issued causes the retaining means to be released, whereby the support arms 52 rock counterclockwise. Thus the feed roller 50 and the urging member 54 move downward, with the arcuate portion 54a of the urging member 54 forcing the corner separators 45 down. The downward movement is interrupted when the feed roller 50 bears against the uppermost sheet S (see FIGS. 8 and 9), and the feed roller 50 which rotates in the direction indicated by an arrow feeds the uppermost sheet S to the left, as viewed in FIG. 9. The point of engagement between the urging member 54 and the corner separator 45 is designated as O. FIG. 9 shows an initial condition for the stack of sheets on the receptacle 47, but it will be appreciated that the number of sheets in a stack gradually decreases as the sheets S are successively fed therefrom. FIG. 10 shows a stack of sheets which is reduced to nearly one-half the number of sheets shown in FIG. 9. Under this condition, the feed roller 50 has descended a corresponding amount, and the arcuate portion 54*a* of the urging member 54 bears against the corner separator 45 at a point P.

Figure 11:
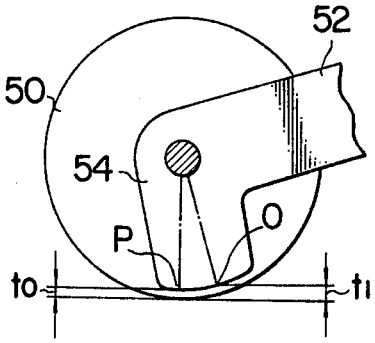
FIG. 11 is a side elevation illustrating the relationship between the feed roller and an urging member associated with the corner separator.

The displacement of the point of engagement between the urging member 54 and the corner separator 45 results from an additional amount of rocking motion experienced by the support arms 52 as the amount of sheets S in the stack varies. Assuming that the number of sheets shown in the stack of FIG. 9 is the maximum, the point of engagement O which occurs in FIG. 9 is displaced to the right of the point P which occurs in FIG. 10 when the number of sheets is halved. The distance $t_1$ between the point O and the uppermost sheet S (see FIG. 11) is greater than the distance $t_0$ between the point P and the uppermost sheet S. This means that if the corner separator 45 is only urged at the point O, the distance between the uppermost sheet and the point of engagement will progressively increase as the number of sheets in the stack decreases. As a consequence, a portion of the feed roller 50 where it bears against the uppermost sheet and the point of engagement of the corner separator will both change in both vertical and horizontal directions as the number of sheets in the stack varies, whereby the pressure exerted by the feed roller and the corner separator to the sheets during a feeding operation will vary, causing instability of separation and feeding of the sheets.

However, with the apparatus of the invention, the corner separator 45 is pressed by the arcuate portion 54*a* of the urging member 54, and the contact between the member 54 and the corner separator 45 occurs at the lowest point on the arcuate portion 54*a* regardless of a change in the number of sheets in the stack, so that the relative position of the point of such contact and the sheet bearing portion of the feed roller 50 remains constant. In other words, the pressure exerted by the feed roller 50 and the corner separator 45 upon the sheet S is maintained constant independently from the number of sheets in the stack, thus assuring a stabilized sheet separation and feeding.

Figure 12:
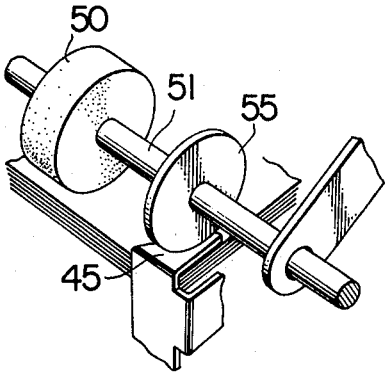
FIG. 12 is a perspective view of another form of the urging member associated with the corner separator.

The urging member may be separate from the support arms for the feed roller. By way of example, FIG. 12 shows the use of a disc 55 having a reduced radius as compared with the radius of the feed roller 50 and loosely fitted on the support shaft 51.

What is claimed is:

1. A sheet feeding apparatus for feeding sheets from a stack disposed on a sheet receptacle, said apparatus comprising:

a pair of pivotable support arms having their free ends rockable toward and away from said sheet receptacle;

a feed roller support shaft rotatably mounted on the free ends of said support arms;

feed roller means on said support shaft for engaging and feeding a sheet from said sheet receptacle;

drive means for rotating said feed roller means;

means for controlling the operation of said drive means;

means for rocking said support arms in a direction to cause said feed roller means to move away from said sheet receptacle at the termination of a feeding operation of a single sheet;

means for retaining said support arms in their removed position;

means for releasing said retaining means at the commencement of a sheet feeding operation;

a pair of corner separators disposed adjacent the opposite corners of the front end of said sheet receptacle for bearing against the opposite corners of the leading end of a sheet during a sheet feeding operation; and means for mounting said corner separators on said support arms for movement at least partly in following relationship with the rocking motion of said support arms whereby said corner separators bear against the opposite corners of the leading end of a sheet only during a sheet feeding operation, said mounting means comprising:

a pair of support links having the corner separators mounted thereon and respectively connected to the free ends of the respective support arms by freely pivoting at one end on the opposite ends of said feed roller support shaft; and a pair of additional pivotable arms each having one of its ends loosely fitted on said rocking means and its other end respectively pivoted to the other ends of said support links.

2. Apparatus as in claim 1 wherein said drive means comprises a spring clutch; and said means for controlling said drive means comprises pivotable lever means for operating said spring clutch, and solenoid means for pivoting said pivotable lever means to operate said spring clutch.

3. Apparatus as in claim 1 wherein said means for rocking said support arms comprises a depending arm formed on at least one of said support arms; a follower member mounted on said depending arm; and a rotatable cam disposed for bearing engagement with the follower member; and wherein said retaining means comprises pivotable lever means for abutting said depending arm.

4. Apparatus as in claim 1 wherein said corner separators are fixedly mounted on said support links and the length of said support arms, support links, and additional pivotable arms are such that said corner separators during vertical movement therewith undergo a lateral displacement away from the leading end of a sheet.

5. Apparatus as in claim 1 wherein said drive means comprises a first rotatable shaft and said rocking means comprises a second rotatable shaft and wherein said support arms are pivoted for rotation on said first rotatable shaft and said additional pivotable arms are pivoted for rotation on said second rotatable shaft.

6. Apparatus as in claim 1 further comprising:

first pivot means for supporting said support arms;

second pivot means for supporting said additional pivotable arms on said rocking means; and means for fixing said first and second pivot means in vertical alignment and against movement with respect to each other.

7. Apparatus as in claim 1 wherein said support arms, support links and additional pivotable arms are connected such that at one position during their pivoting said support arms and said additional pivotable arms are parallel and wherein the angle of rotation $\theta_1$ of said support arms from said parallel position to their removed position is not less than the angle or rotation $\theta_2$ of said support arms from said parallel position to the position of engagement of said corner separators with the opposite corners of the leading end of a sheet during a sheet feeding operation.

8. Apparatus as in claim 1 wherein said support links have slot means along their lengths for permitting movement of said feed roller support shaft therein whereby relative movement between said support arms and said corner separators is permitted.

9. Apparatus as in claim 8 further comprising spring means connected between said support arms and said support links for urging said corner separators against the opposite corners of the leading end of a sheet during a sheet feeding operation.

* * * * *